US005730931A

United States Patent [19]

Poniatowski et al.

[11] Patent Number: 5,730,931

[45] Date of Patent: Mar. 24, 1998

[54] HEAT-RESISTANT PLATINUM MATERIAL

[75] Inventors: Manfred Poniatowski, Bruchkobel; Ernst Drost, Alzenau; Stefan Zeuner, Friedrichsdorf, all of Germany

[73] Assignee: Degussa Aktiengesellschaft, Frankfurt am Main, Germany

[21] Appl. No.: 698,857

[22] Filed: Aug. 16, 1996

[30] Foreign Application Priority Data

Aug. 25, 1995 [DE] Germany ..... 195 31 242.2

[51] Int. Cl.[6] ..... C22C 5/04

[52] U.S. Cl. ..... 420/466; 75/230; 75/233; 75/235

[58] Field of Search ..... 420/466; 148/430; 75/230, 233, 235; C22C 5/04

[56] References Cited

U.S. PATENT DOCUMENTS

| | | | |
|---|---|---|---|
| 3,622,310 | 11/1971 | Reinacher et al. | 420/466 |
| 3,709,667 | 1/1973 | Selman et al. | 419/19 |
| 4,014,692 | 3/1977 | Costin . | |
| 4,123,263 | 10/1978 | Costin . | |
| 4,252,558 | 2/1981 | Touboul et al. | 148/430 |
| 4,819,859 | 4/1989 | Schwenninger | 420/466 |

FOREIGN PATENT DOCUMENTS

| | | | |
|---|---|---|---|
| 670897 | 1/1939 | German Dem. Rep. | 420/466 |
| 06212321 | 8/1994 | Japan | C22C 5/04 |

OTHER PUBLICATIONS

Chem Abs 123: 206191 of JP 7-150, 271 1995.

Chem Abs 123: 63422 of RU 2017584 1995.

*Primary Examiner*—David A. Simmons

*Assistant Examiner*—Margery S. Phipps

*Attorney, Agent, or Firm*—Beveridge, DeGrandi, Weilacher & Young, LLP

[57] ABSTRACT

A heat-resistant platinum material with more than 99.5% by weight platinum, with high long-term creep resistance and low grain growth at high temperature contains 0.1 to 0.35% by weight zirconium and/or zirconium oxide and 0.002 to 0.02% by weight boron and/or boron oxide.

4 Claims, No Drawings

HEAT-RESISTANT PLATINUM MATERIAL

INTRODUCTION AND BACKGROUND

The invention concerns a heat-resistant platinum material which can be used for many applications in industry and in the laboratory where there are special requirements for mechanical, thermal and chemical resistance.

Various technical measures for increasing the heat resistance of platinum are known. The most efficient method is based on dispersion hardening, homogeneous distribution of a small proportion (e.g., <1% by weight) of thermally stable hard particles which are not soluble in the metal, having particle sizes <50 nm. Dispersoids of this type prevent dislocation movements in the lattice, and thus prevent macroscopic deformation for a long time at high temperature. Thus they prevent premature material failure due to grain coarsening, yielding and breakage.

Such qualities of platinum materials are increasingly needed for high-temperature use in the glass industry, in petrochemistry, in laboratory equipment, and in spark plugs for engines. Zirconium oxide and yttrium oxide are used preferentially as dispersoids.

Different variations of powder metallurgy are utilized to produce these materials; but they are basically expensive, and cannot always be used for various requirements.

Therefore, production methods based on conventional fusion metallurgy are also used, with alloy techniques tried to achieve grain size stabilization.

For instance, U.S. Pat. No. 4,123,263 describes a platinum material for glass fiber nozzles, which contains not only platinum but also 10 to 40% by weight rhodium, 0.015 to 1.5% by weight zirconium and/or yttrium, and 0.001 to 0.5% by weight boron. Production is by fusion metallurgy with intermediate annealing during shaping. This material does have improved creep resistance, but the long-term creep resistance and resistance to grain growth are inadequate. Furthermore, the addition of rhodium, which is essentially responsible for the creep strength of the material, substantially increases the cost; and it is undesirable for melting optical glasses, for example, as rhodium dissolves in small proportions in glass smelts, giving a yellow coloration.

A platinum alloy is known from East German patent 157 709, which contains 0.5 to 5% by weight gold and/or nickel, 0.01 to 0.5% by weight yttrium, 0.001 to 0.5% by weight calcium and 0.001 to 0.5% by weight boron. This material is also produced by fusion metallurgy, and can be used in the internally oxidized state.

The fusion metallurgic processing of alloys containing yttrium and calcium, and maintenance of the required tolerances in the concentrations are difficult to accomplish. The low ductility of such materials, especially after internal oxidation, makes them unsatisfactory for processing into equipment and other forms. Also, addition of gold and/or nickel is not desirable in certain applications.

Therefore it was the objective of this invention to find a heat-resistant platinum material containing more than 99.5% by weight platinum, which has high long-term creep resistance and very low grain growth at high temperatures, and which can easily be produced by fusion metallurgy.

SUMMARY OF THE INVENTION

The objective is attained according to the invention by a platinum material which contains, along with natural impurities, 0.10 to 0.35% by weight zirconium and/or zirconium oxide and 0.002 to 0.02% by weight boron and/or boron oxide, the remainder being platinum.

It is preferable for the material to contain 0.15 to 0.25% by weight zirconium and/or zirconium oxide and 0.005 to 0.01% by weight boron and/or boron oxide.

It is known that additions of zirconium to platinum alloys in proportions of less than 0.5% by weight reduce the grain size. That is accompanied by distinctly higher strength in comparison with unalloyed platinum. The long-term creep resistance is also higher. However, grain coarsening through secondary recrystallization, resulting in premature failure by slippage fracture, cannot be avoided at higher temperatures.

Additions of extremely small proportions of boron to the zirconium—these are clearly below the known solubility limits (ca. 0.75 atom-percent, or 0.04% by weight boron)—cause a considerably more stable fine-grain structure with a mean grain diameter of about 50 mm. The grain boundaries exhibit seams or particles of a second phase, about 1 mm in diameter, arranged like strings of beads. It can be shown with X-ray emission spectra that they are ZrB compounds which accumulate at the grain boundaries and limit the grain growth. Such a structure attains much higher long-term creep resistance than platinum-zirconium alloys without added boron. More improvement can be achieved if these particles are partially or completely converted to oxides by ignition in air before use at high temperature, although a coarsening of the particles is observed.

Surprisingly, these strengthening mechanisms, combined with strong inhibition of grain growth, remain even in platinum materials with more than 99.5% by weight platinum if one stays within the zirconium and boron ranges according to the invention.

DETAILED DESCRIPTION OF THE INVENTION

In order to produce the material, it is preferable to work with platinum-zirconium and platinum-boron prealloys so that the small proportions of zirconium and boron in the material can be adjusted as accurately as possible.

The following examples will explain the invention in more detail:

1. 500 g pure platinum and 1.7 g of a PtZr 35/65% by weight prealloy (eutectic temperature 1180° C.) was fused at reduced pressure under argon in a zirconium oxide crucible in a vacuum induction fusion furnace, and was cast in small bars in a cooled copper mold. A sheet 1 mm thick was produced by cold-rolling (degree of rolling 90%). The material characteristics listed in the table were determined after a final ignition (0.5 hour, 1000° C.). The intended composition was PtZr 0.22%. PtZr 0.22 is a conventional alloy and serves for comparison.
2. 500 g pure platinum, 1.7 g of a PtZr 35/65% by weight prealloy, and 5 g of a PtB99/1% prealloy was produced in the same way as in Example 1 and made into a sheet. The material characteristics are also listed in the table. The intended composition was PtZr 0.21 B 0.009.
3.–6. Alloys were produced in a manner similar to Example 2, with varying B and/or Zr contents. As the table shows, Zr contents <0.1% by weight give clearly lower tensile strengths (Rm) at room temperature (RT) as well as reduced long-term creep resistance (Rm) at 1300° C. Zr contents >0.35% do increase the strength, but the limit the workability because of reduced ductility. Similarly, the effectiveness of boron on the long-term creep resistance is already clearly limited at concentrations of 0.005% by weight.
7. An alloy having the composition of Example 2 is subjected to a final oxidative ignition, in which the grain boundary exclusions are converted into more thermally stable oxides. This leads to an increase in the long-term creep resistance from 4.2 to 5.8 Mpa. This advantage, though, is linked to lower room-temperature ductility (10–15% instead of 24% elongation at rupture).

8. This example serves for comparison with a material produced by powder metallurgy (FKS platinum). The substantially higher long-term creep resistance is characteristic here, with lower values for strength and ductility than in the materials according to the invention. Furthermore, the costly production of materials by powder metallurgy is justified only for special thermomechanical stresses in use, while the materials produced according to the invention are an economical alternative, thus distinctly expanding the range of application.

Further variations and modifications of the foregoing will be apparent to those skilled in the art and are intended to be encompassed by the claims appended hereto.

TABLE

| Example | Composition (% by weight) | Treatment | $R_m$ (RT) (MPa) | A (RT) (%) | $R_m$ (1300° C./100 hr) MPa |
|---|---|---|---|---|---|
| 1 | PtZr 0.22 | 1000° C./0.5 hr/Ar | 210 | 30 | 2.2 |
| 2 | PtZr 0.21 B 0.009 | 1000° C./0.5 hr/Ar | 250 | 24 | 4.2 |
| 3 | PtZr 0.1 B 0.01 | 1000° C./0.5 hr/Ar | 200 | 27 | 3.2 |
| 4 | PtZr 0.35 B 0.01 | 1000° C./0.5 hr/Ar | 280 | 10 | 6.0 |
| 5 | PtZr 0.22 B 0.005 | 1000° C./0.5 hr/Ar | 270 | 30 | 2.6 |
| 6 | PtZr 0.22 B 0.002 | 1000° C./0.5 hr/Ar | 270 | 25 | 4.3 |
| 7 | PtZr 0.21 B 0.009 | 1000° C./0.5 hr/Ar | 260 | 10–15 | 5.7 |

TABLE-continued

| Example | Composition (% by weight) | Treatment | $R_m$ (RT) (MPa) | A (RT) (%) | $R_m$ (1300° C./100 hr) MPa |
|---|---|---|---|---|---|
| 8 | FKS-Pt16 ($PtZrO_2$) | 1000° C./0.5 hr/Ar | 230 | 18 | 10.5 |

$R_m$ = tensile strength or long-term creep resistance
A = elongation at fracture
The long-term creep resistance studies at 1300° C. were done with plate samples (0.5 mm) in air.

We claim:

1. Heat-resistant platinum material consisting essentially of;

(A) more than 99.5% by weight platinum, (B) an additive selected from the group consisting of, zirconium, zirconium oxide, and mixtures thereof in the amount ranging from 0.1 to 0.35% by weight, and (C) an additive selected from the group consisting of, boron, boron oxide, and mixtures thereof in the amount ranging from 0.005 to 0.02% by weight.

2. Heat-resistant platinum material consisting essentially of;

(A) more than 99.5% by weight platinum, (B) an additive selected from the group consisting of, zirconium, zirconium oxide, and mixtures thereof in the amount ranging from 0.15 to 0.25% by weight, and (C) an additive selected from the group consisting of, boron, boron oxide, and mixtures thereof in the amount ranging from 0.005 to 0.01% by weight.

3. The heat resistant platinum material according to claim 1 which is in finely divided form.

4. The heat resistant platinum material according to claim 2 which is in finely divided form.

* * * * *